United States Patent [19]

Fournier

[11] 4,331,255

[45] May 25, 1982

[54] CUP COVER

[76] Inventor: George J. Fournier, 34 Waldo Rd., Milton, Mass. 02187

[21] Appl. No.: 178,961

[22] Filed: Aug. 18, 1980

[51] Int. Cl.[3] ..... A47G 19/22; B65D 41/26

[52] U.S. Cl. ..... 220/259; 220/90.4; 220/270; 222/547

[58] Field of Search ..... 220/259, 256, 254, 270, 220/90.2, 90.4; 222/454, 424.5, 564, 547

[56] References Cited

U.S. PATENT DOCUMENTS

| | | | |
|---|---|---|---|
| 1,949,357 | 2/1934 | Cross | 222/424.5 |
| 2,695,732 | 11/1954 | Tupper | 220/256 |
| 2,867,359 | 1/1959 | Adams | 222/547 X |
| 3,342,383 | 9/1967 | Klysis et al. | 222/564 X |
| 3,360,161 | 12/1967 | Smith | 220/90.4 |
| 3,680,744 | 8/1972 | Daniels, Jr. | 222/454 X |
| 3,727,808 | 4/1973 | Fitzgerald | 220/90.4 |
| 4,138,033 | 2/1979 | Payne et al. | 220/90.4 |

*Primary Examiner*—Allan N. Shoap
*Attorney, Agent, or Firm*—Cesari and McKenna

[57] ABSTRACT

A unitary nonspilling container cover comprises a pair of similarly dimensioned discoid sections each having a peripheral channel and a flexible hinge connecting their peripheries. The two sections are oriented so that the second section can be flipped over onto the first so that the peripheral channel on the second section engages over the peripheral channel on the first section to provide a shallow space between the two sections bounded by peripheral seal. An array of small openings are provided in the first section leaving a relatively large contiguous imperforate area in that section. A removable tab is provided for forming a drinking opening in the second section, the tab being positioned so that it is disposed opposite the imperforate area in the first section.

5 Claims, 4 Drawing Figures

CUP COVER

This is a substitute of Ser. No. 28,119, filed Apr. 9, 1979 and now abandoned.

This invention relates to an improved cup cover. It relates more particularly to an anti-spill cover for a hot drink container such as a coffee cup.

BACKGROUND OF THE INVENTION

As society becomes more and more mobile, the numbers of roadside restaurants and other drive-in establishments providing beverages has burgeoned. There has been a concomitant increase in the number of take-out orders of beverages such as hot coffee and tea. The containers for these beverages usually consist of cardboard, plastic or styrofoam cups, many of which are fitted with cardboard or plastic covers to prevent the container contents from sloshing about and spilling as the consumer carries the container to his car. Once seated, the customer can then remove the cover and consume the contents of the cup.

In many cases, the customer may wish to drink from the cup and yet still be protected from spillage in the event that he or the container is jostled by a nearby person or by the swaying and bumping motions of the car. To this end, a variety of different container covers have been proposed which are intended to minimize the incidence of spillage due to the "loose water effect." Usually these covers take the form of cardboard or plastic disks which engage over the rim of the cup. A tab is provided in the cover which can be stripped away to provide an opening through the cover so that the customer can drink the contents of the cup. The presence of the remainder of the cover minimizes spillage due to the sloshing of the liquid contents which can only escape through that relatively small opening.

While that prior type cover does alleviate the problem to some extent, it still does not eliminate it. If the container happens to be tilted as the customer is drinking, even a slight jostling of the container will cause the liquid contents to splash up through the opening whereupon it may spill on the customer's clothes and, if it is a hot drink, burn his face or hands.

Other cup covers of which we are aware are provided with upstanding drinking spouts which the customer can place between his lips while consuming the contents of the cup. While that type of cover is satisfactory for a cold drink, it is not suitable for dispensing a hot drink such as hot coffee. This is because one normally uses his lips to sense the temperature of a drink because the lips are the most sensitive part of the mouth. Actually one tests whether or not a particular drink is too hot by gingerly sipping the beverage at the rim of the cup, taking great care to allow only a very minimum amount of liquid to pass between the lips.

Such care is not possible when drawing in liquid through a spout because one cannot exercise close control over the amount of liquid being ingested. By the time the customer finds out that the beverage is too hot, it is too late because he has already drawn in an excessive amount of the liquid which thereupon proceeds to burn his mouth.

Other more elaborate covers have been proposed. However, these usually comprise multiple pieces which must be made separately, inventoried separately and installed in the cup separately, making them excessively expensive and inconvenient to stock and to use.

Often also when a container is practically empty, the customer may place the container on some sort of surface such as a seat or dashboard and, thereupon, due to vibrations of the automobile, the container may tip over. Even with the aforesaid prior covers, the rest of the container contents is free to spill out through the drinking openings in those covers.

SUMMARY OF THE INVENTION

Accordingly, the present invention aims to provide an improved container cover which prevents the container contents from spilling.

Another object of the invention is to provide a cover of this type which is especially suited for a hot beverage container.

Another object is to provide such a cover which is of unitary construction.

A further object of the invention is to provide an anti-spill container cover for use particularly on a hot beverage container such as a coffee cup and which does not interfere with the normal mode of sipping or sampling a hot liquid.

A further object of the invention is to provide a beverage container of this general type which prevents spilling of the residual contents of the container even if the container is tipped over.

Still another object of the invention is to provide such a cover which is relatively inexpensive to make and which is easily fitted on any conventional cup or other container.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, although the subject cover can be formed of paperboard stock, it is most preferably molded of plastic as a unitary piece. The cover comprises a pair of coextensive discoid sections connected together at their edges by an integral flexible strap or hinge. The specific diameters of the two cover sections depends upon the size of the cup that the cover is intended to close.

One cover section has a depressed discoid central portion surrounded by an inverted annular U-shaped channel which is arranged to engage over the rim of the cup like many of the conventional plastic covers of this general type. The second cover section is similar to the first in having a discoid central portion surrounded by an annular U-shaped channel. However, the second section is inverted with respect to the first so that the second section can be flippd over, the flexible strap acting as a hinge, and superimposed on the first section with the annular channel of the second section engaging over the upstanding rib formed by the annular channel on the first section, thereby forming a shallow space between the two sections and a fluid-tight peripheral seal between the two sections and bounding said space.

Also formed in the central portion of the first cover section is an array of small openings which openings are sufficiently localized as to leave a relatively large sector of that central portion imperforate.

Additionally a tear tab is provided at the edge of the central portion of the second cover section at a location therein such that when the two sections are superimposed as aforesaid, the tab overlies the imperforate section of the first cover section. Thus when the tab is removed, it leaves an opening in the second cover section adjacent the rim of the cup which opening is out of register with the openings in the first cover section.

If now the cumstomer wishes to sip from the cup to sample its contents, he places his lips upon the rim of the cup at the cover opening in the usual way and tilts the cup. The liquid in the cup flows through the openings in the innermost cover section along the space between the two sections to the opening in the outer second cover section to the customer's lips. The flow of liquid thus proceeds in a controlled fashion to the lip of the cup where the customer can sip it exactly as he would do with a coverless cup. Consequently, there is little danger of the liquid contents burning the customer should it be hot.

While the present cover permits the customer to drink freely from the cup, in the event that the container is jostled or even if the cup is shaken quite violently, little or no liquid escapes from the cup through the drinking opening in the outer cover section. This is because the inner cover section functions as a baffle which inhibits the loose water effect. Further such water in motion even through it may slosh up through one or more of the small openings in the inner cover section, in order to escape from the cup it must make a right angle turn between the two cover sections and travel along the shallow space between the two sections and then make another right angle turn at the drinking opening in the outer cover section which, tests have shown, the liquid has little or no tendency to do. Resultantly, even when the container thus covered is shaken violently, little or no liquid escapes through the cover. Preferably the central portion of the inner cover section is dished or otherwise inclined toward and opening in the inner section so that any liquid present between the cover sections automatically drains back into the cup.

Even if the covered cup should tip over on its side after most of its contents has been consumed, liquid still cannot spill from the cup. This is because unless the openings in the inner cover section are positioned near the surface on which the cup reposes, the residual liquid cannot flow past that section. In the event those openings are positioned near that surface, then the opening in the outer cover is by definition spaced away from those openings and thus away from that surface so that the liquid cannot pass through the outer cover section.

The present cover is advantaged also in that it is a unitary molded plastic piece having male and female faces so that the pieces can be arranged in a nesting stack near the point of purchase of the beverage. After a salesperson fills a cup with a beverage, he simply places the first or inner cover section over the rim of the cup in the usual way and flips over the second or outer cover section. The hinge between the two sections not only secures the two sections together but also fixes their inversely related dispositions and relative orientation so as to assure that the two sections are secured properly to the cup with their openings out of register as discussed above.

Yet with all of these advantages the present cover should not cost appreciably more than prior comparable covers of this general type.

While we have described the cup cover in terms of its application to various beverages sold by restaurants and other public establishments, it should be understood that the invention has equal application in any situation where it is desired to prevent the contents of a cup or other container from spilling. For example, such covers may be used on the containers used by persons in hospitals, institutions or at home who are unable to control the movements of their hands or arms due to age or some affliction. Likewise, such covers can be used on containers from which young children drink to minimize the incidence of spillage. Therefore the cover should certainly be viewed in this broader context.

BRIEF DESCRIPTION OF THE DRAWING

For a fuller understanding of the nature and objects of the invention, reference should be had to the following detailed description taken in connection with the accompanying drawing, in which.

Description of an Illustrative Embodiment

Figure 1:
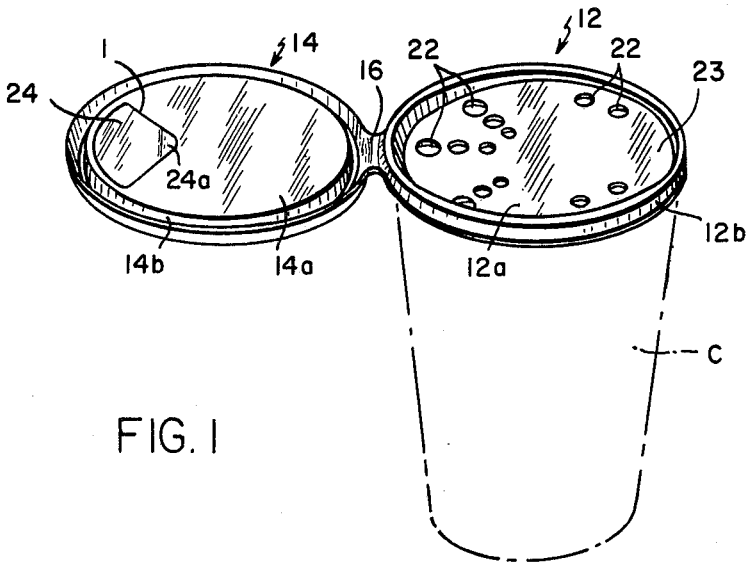
FIG. 1 is a perspective view of a container cover made in accordance with this invention.
Figure 2:
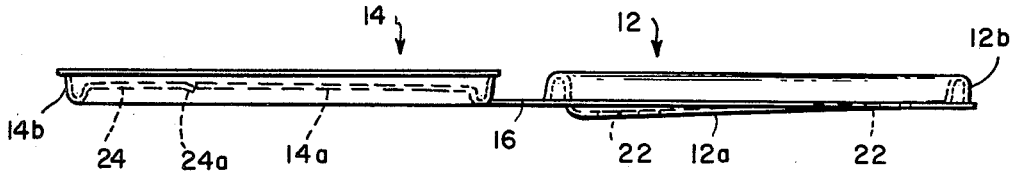
FIG. 2 is a view in side elevation on a larger scale of the cover depicted in FIG. 1.
Figure 3:
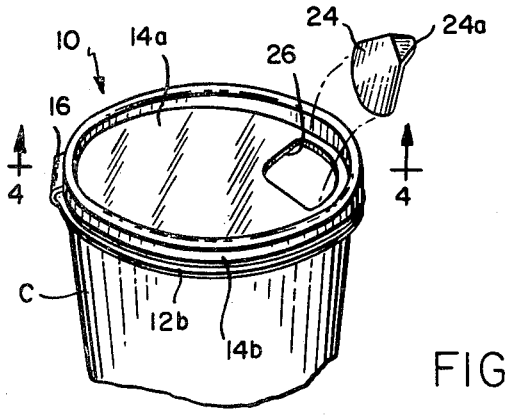
FIG. 3 is a view similar to FIG. 1 showing the cover in its installed position.

Referring now to FIGS. 1 and 2 of the drawing, my cover indicated generally at 10 is preferably made of plastic such as, for example, filled polystyrene and is molded as a unitary part or piece. As such, it can be made from the very same material and in exactly the same way as prior plastic cup covers. Cover 10 comprises a first, herein denominated inner, discoid cover section indicated at 12 and a second, so-called outer discoid cover section indicated at 14 which is coextensive with section 12. The two sections are connected together at their edges by a flexible strap or hinge 16. Hinge 16 is long enough to permit section 14 to be flipped over onto section 12 so that the two sections can be superimposed as shown in FIG. 3.

Cover section 12 comprises a circular depressed central portion **12*a* which is surrounded by an annular inverted U-shaped channel 12*b*. Channel 12*b*** is sized so that it can resiliently engage over the rim of a conventional cup or container indicated in dotted lines at C.

Cover section 14 also has a circular central portion **14*a* surrounded by a peripheral U-shaped channel 14*b*. Channel 14*b* is somewhat wider than channel 14*a* so that when the two cover sections are superimposed as shown in FIG. 3, channel 14*b* can engage over the upstanding circular ribs formed by channel 12*b* to resiliently secure those two sections together and provide a fluid-tight peripheral seal between them. As shown in FIG. 2, the two cover sections 12 and 14** are more or less the same size so that the aforesaid superposition can be accomplished.

Still referring to FIGS. 1 and 2, the central portion **12*a* of cover section 12 is formed with an array of small openings 22 which extend through that cover section. Openings 22 are arrayed so as to leave a relatively large area portion 12*a* section 23 which is imperforate. The central portion 14*a* of cover section 14 on the other hand is weakened along a tear line T to define a tab 24 adjacent the channel 14*a*. As best seen in FIG. 2, the tab 24 is provided with an accessible outstruck tip or edge 24*a* to facilitate grasping the tab and tearing it along tear line T. It should be understood that the array of openings 22 and tab 24** are not similarly positioned on the two sections.

Figure 4:
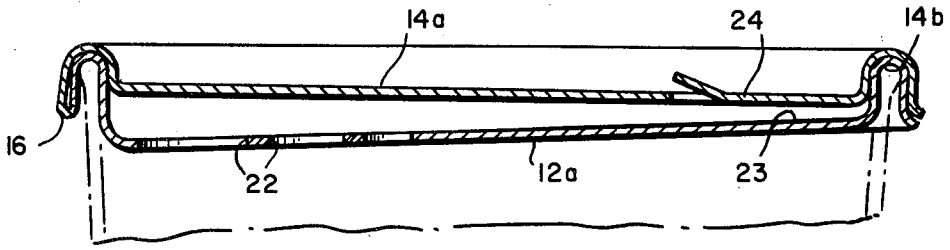
FIG. 4 is a sectional view along line 4—4 of FIG. 3.

Turning now to FIGS. 1, 3 and 4, the cover 10 is installed on cup C by fitting channel **12*b* on the rim of cup C. Trapped air is free to escape through the openings. The channel walls resiliently engage the cup rim in the usual way, thereby forming a fluid-tight seal all around the cup. Next, the cover section 14 is flipped over onto section 12 about its hinge 16 and pressed down onto section 12 so that channel 14***b* engages over the upstanding circular rib formed by channel 12*b* thereby securing the two sections together and forming a fluid-tight seal all around the peripheries of the two cover sections. Here again any air trapped between the sections can escape through the tiny openings in section 14 provided by the outstruck flap tip 24*a*.

When the two cover sections are secured together as shown in FIG. 3, a shallow space 26 exists between their central portions 12*a* and 14*a* respectively. Also, it is apparent that the array of openings 22 in the inner section 12 are not in register with the tab 24 in section 14. Rather that tab is disposed opposite the imperforate sector 23 of the inner cover section.

Thus it is apparent from the foregoing that, due to the presence of the integral hinge 16 connecting the two cover sections, the two sections are always maintained in the proper position for superpostion and engagement. Furthermore, the same hinge fixes their orientations about the cup axis so that the tab 24 is always properly oriented directly above the imperforate sector 23 of cover section 12.

When it is time to consume the contents of the container C. the customer simply strips away tab 24 leaving an opening 28 in the outer cup section 14 which opening is situated right adjacent the channel 14*b*. The tab 24 (and therefore opening 28) is sized to provide an adequate drinking orifice for the average mouth. In order to drink the contents of the cup, the customer simply tilts the cup in the usual way. Thereupon, the liquid flows up through the openings 22 in the inner cover section 12 and flows along the relatively shallow space 26 between the two cover sections to the opening 26 in the outer cover section.

It should be understood that the total area of the openings 22 and the depth of space 28 are sufficiently large to permit a healthy flow of fluid from the cup to the opening 26 where it is accessible to the customer. Since the opening 26 is located right adjacent the rim of the cup, the customer can sip and test the temperature of the beverage as he normally would if there were no cover. Consequently, there is little likelihood of his being burned if the liquid is too hot. Thus the customer can consume the content in the usual way without changing his normal routine.

On the other hand, the inner cover section 12 with its openings 22 and the shallow passage 28 and the out-of-register opening 28 provide definite protection against accidental spillage from the cup C. More particularly, if the cup is jostled, the imperforate surfaces of the cover section 12 act as a baffle which minimizes the loose water effect within container C. Some liquid may be propelled up through some openings 22. However, those openings are spaced apart and are sufficiently small that the ejected liquid mass is broken up and does not acquire appreciable velocity. Moreover even such liquid as does pass through openings 22 impinges upon the imperforate portion of the overlying cover section 14 and is therefore driven back down toward section 12 where it may flow back through one or another of the openings 22.

In a preferred cover embodiment, the portion 12*a* of cover section 12 is dished or otherwise slopes so as to preferentially conduct the liquid in the space 28 between the two cover sections toward one or another of the openings 22. Thus as best seen in FIG. 2 in the illustrated embodiment, the portion 12*a* slopes toward the left as viewed in that figure away from the imperforate sector 23 toward one or more openings 22 adjacent hinge 16.

In any event, such liquid as is driven up through openings 22 by inertia, in order to pass along passage 28 must redirect itself through a right angle. Consequently it loses an appreciable amount of its velocity and energy. Resultantly, very little or none of that liquid ever reaches the relatively remote opening 28 through the outer cover section 14. Rather the jostles or movements of the cup are usually sufficiently abrupt and random that they do not reinforce one another so that the liquid in passage 26 tends to drain back into the cup through one or another of the passages 22 faster than fresh liquid is propelled up through those openings. Indeed the cup C fitted with cover 10 can be shaken rather violently without any liquid being expelled from the opening 26 in the outer cover section.

It is apparent that preferably the opening 26 and at least some openings 22 should be in adjacent sectors about the cup axis so that the customer can consume a maximum amount of the cup contents without having to rotate the cup about that axis.

After most of the contents of cup C is consumed, there may be some very small volume left in the cup due to the presence of cover 10. The customer can then remove the cover and completely drain the cup or set the cup down with the cover still on until it is convenient to discard the cup. Even then, should the cup tip over on its side, any small amount of liquid left in the cup cannot spill because the liquid cannot pass through openings 22 unless those openings are near the ground or floor. In that event, due to the out-of-register positioning of the openings 22 and 46, the opening 46 must necessarily be located well above the ground or floor. Consequently any liquid finding its way into space 26 could not pass out through opening 28 in outer cover section 46.

It will be seen from the foregoing, then, that my cup cover provides definite advantages in terms of preventing accidental spillage of beverages, particularly hot beverages, in situations in which the beverage container is shaken about or jostled. Yet, the cover being molded as a single piece can be manufactured at minimum cost and fitted to the cup with minimum effort. Consequently, the cover should find wide acceptance in the marketplace.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing be interpreted as illustrative and not in a limiting sense.

It is also to be understood that the following claims are intended to cover all of the generic and specific features of the invention herein described.

I claim:

1. A cover for a container comprising

A. a first discoid cover section, said first cover section including 1. a peripheral channel, said channel being arranged to resiliently engage over the rim of a cup or other container, 2. an array of relatively small openings, and
3. a relatively large contiguous area which is imperforate, B. a second discoid cover section having substantially the same dimensions as the first section, said second cover section having
1. a peripheral channel arranged and adapted to resiliently engage over the channel on the first cover section, and
2. means in the second cover section for producing a defined opening therein, C. an integral hinge connecting the two cover sections so that the second section can be flipped over and superimposed on the first section with its channel engaging the first section channel so as create a shallow passage between the two sections which is bounded by a peripheral fluid-tight seal, the array of openings in the first section and the opening producing means in the second section being positioned relative to the hinge so that, when the two sections are superimposed, the opening producing means is positioned directly above said imperforate area of the first cover section.

2. The cover defined in claim 1 wherein the opening producing means comprises a tear tab which can be stripped away to leave an opening in the second cover section.

3. The cover defined in claim 1 wherein the two cover sections and hinge are molded together as a single unitary plastic piece.

4. The cover defined in claim 1 wherein
A. at least the central portion of the first cover section slopes relative to the plane defined by the peripheral channel of that section,
B. the imperforate portion is located near the top of the slope, and
C. at last one said passage is located at the bottom of said slope.

5. The cover defined in claim 1 wherein when said two cover sections are superimposed, the array of openings on the first section and the opening-producing means on the second section are located in adjacent angular sectors about the axis of the two sections.

* * * * *